US006873879B2

(12) United States Patent
Bush et al.

(10) Patent No.: US 6,873,879 B2
(45) Date of Patent: Mar. 29, 2005

(54) WINDING CONTROL PROCESS AND PROGRAM

(75) Inventors: Kevin Joe Bush, Newport, WA (US); Christopher Robin Martin, Newport, WA (US)

(73) Assignee: Bowater, Incorporated, Greenville, SC (US)

( * ) Notice: Subject to any disclaimer, the term of this patent is extended or adjusted under 35 U.S.C. 154(b) by 61 days.

(21) Appl. No.: 10/205,968

(22) Filed: Jul. 26, 2002

(65) Prior Publication Data

US 2004/0019401 A1 Jan. 29, 2004

(51) Int. Cl.[7] ..... G06F 19/00

(52) U.S. Cl. ..... 700/126; 242/534; 242/563.2; 700/122

(58) Field of Search ..... 700/122, 126, 700/127, 128; 242/530.4, 534, 534.2, 563.2, 485.7, 413.1; 345/866

(56) References Cited

U.S. PATENT DOCUMENTS 5,806,785 A * 9/1998 Laplante et al. ..... 242/534
6,124,855 A * 9/2000 Sells ..... 345/866
6,260,787 B1 * 7/2001 Michel et al. ..... 242/530.4
6,402,076 B1 * 6/2002 Werner ..... 242/413.1

FOREIGN PATENT DOCUMENTS

JP 9-301585 * 11/1997

* cited by examiner

*Primary Examiner*—Leo Picard
*Assistant Examiner*—Steven R. Garland
(74) *Attorney, Agent, or Firm*—Stephen J. Shaw; Nexsen Pruet, LLC

(57) ABSTRACT

A fully-integrated computer-aided method for sizing and building paper reels from which a plurality of smaller rolls of paper are created. Data pertaining to the measurements of paper reels and the rolls to be built therefrom is entered into a computer programmed with electronic spreadsheet software, which stores, validates and computes measurement values so that the diameter of the paper reel from which the smaller paper reels are being built is of the correct size to minimize waste.

22 Claims, 10 Drawing Sheets

WINDING CONTROL PROCESS AND PROGRAM

FIELD OF THE INVENTION

The present invention relates generally to the paper creation process. It reduces waste of both materials and time when creating rolls of paper. This invention relates to a computer-aided method for sizing and building paper reels from which a plurality of smaller rolls of paper are created.

BACKGROUND OF THE INVENTION

The process of creating several rolls of paper, such as newsprint, first involves creating a large "parent reel" of paper. The paper on this parent reel is then routed through a machine which slices the paper into varying widths and winds the sliced paper into rolls of varying diameter.

FIG. 1 illustrates aspects of the paper roll building process. The parent reel 1 is placed on a spool 2. The reel diameter 3 is a term of art, and refers to the distance between the edge of the spool and the outer edge of the reel. Paper from the reel 1 is fed through a machine 9 which slices the paper into the desired width and winds the paper into rolls 5 of varying set diameter 7.

Waste can occur in the process when the parent reel is either of insufficient diameter or excess diameter with respect to the diameter of the smaller rolls being built from the parent reel. The preferred method of paper roll manufacture is building parent reels to the exact size necessary to wind the needed sets of rolls, so that a minimum of parent reel building must take place. Unfortunately, this rarely happens, and the failure to do so results in waste of paper, materials, energy and labor. Often, extra paper is added to the parent reels to ensure that the roll diameter is not smaller than that ordered by the customer.

If the parent reel does not contain enough paper to make the rolls, the process must be halted while another parent reel is loaded, and the seam on a roll where the paper from the previous parent reel and the new parent reel meets must be mended.

Paper remaining on a parent reel after rolls are wound from it is called slab loss. This slab loss is excess and often ends up being discarded if the slab loss is of insufficient diameter to go through the winder without being topped-out or due to other reasons. A top-out is using paper from one parent reel and splicing it to a partially-built set from another parent reel. A top-out is necessary when the paper remaining on the parent reel is not long enough to build another set of rolls. Often, slab loss will increase after a succession of top-outs, as more paper is wound onto the parent reel than is necessary to build the rolls because the existing slab loss is not fully taken into consideration. When this occurs, the paper being loaded onto the parent reel must be cut back; specifically, the parent reel's optimal diameter must be reduced, so as to fully utilize all paper on the reel and eliminate the accumulating slab loss.

Waste also occurs when the parent reel contains cull paper in the midst of the parent reel. Cull paper is paper that cannot be used in the rolls because it does not match the required specifications. The winding process will sometimes cease prior to the cull paper being wound into the rolls, the cull paper must be removed or wound onto another set. The winding process must then begin again, after which there is a high probability of slab loss due to human error in calculating the proper size for the parent reel when taking the cull paper into consideration.

There are occasions when combinations of the above scenarios occur, such as building a top-out for a parent reel from which cull paper must be removed, or combining smaller reels into one parent reel for which a top-out is needed. In these situations, operator error and miscalculations are even more prevalent, resulting in waste.

The conventional methods of paper manufacture do not address the above problems. Responsibility for the requisite complicated mathematical computations and problem-solving falls to workers who may be inadequately trained, or whom are simply overwhelmed with the speed of the manufacturing process and the precision required to minimize waste in an environment with numerous workers, heavy materials and dangerous, fast-moving machinery.

There is a need for a new method of dealing with the aforementioned difficulties which allows for precise, immediate calculations of the parent reel size needed for a particular job, along with the ability to calculate slab loss, top-outs, the location of defects in a reel, and similar tasks. This method must be flexible enough to perform all the aforementioned calculations yet restrictive enough so as to minimize mistakes due to operator error.

BRIEF SUMMARY OF THE INVENTION

An object of the present invention is to calculate the preferred diameter for a parent reel being built so as to minimize waste when rolls are built therefrom.

Another object of the present invention is to calculate the preferred diameter for a reel which must be cut back by either a known or unknown amount in order to minimize slab loss.

Yet another object of the present invention is to perform calculations where a top-out is necessary for a reel from which rolls of paper consisting of one or multiple diameters are being built.

And another object of the present invention is to perform calculations where cull paper is present in the parent reel, and a top-out may or may not be necessary.

Another object of the present invention is to calculate the total linear footage in a reel and the linear footage to a defect in a reel.

The invention is a fully-integrated computer-aided method for aiding the reel-building process, using a computer programmed with electronic spreadsheet software. Data pertaining to the measurements of paper reels and the rolls to be built therefrom is entered into the spreadsheet. This data is stored, and compared to preexisting formulas and data embedded in the spreadsheet. These comparisons serve to validate that the data is within acceptable limits. The data is then used in calculations using the preexisting formulas and data, which result in new values being generated and stored. These new values are then displayed in a format which is readable for use in the paper-building process. This computer-aided method provides consistency and precision in the calculations involved in the reel-building process.

The invention itself, together with further objects and attendant advantages, will best be understood by reference to the following detailed description taken in conjunction with the accompanying drawings which illustrate by way of example, the principles and objects of the invention.

DETAILED DESCRIPTION OF THE INVENTION

The invention is a fully-integrated computer-aided method for sizing and building paper reels from which a plurality of smaller rolls of paper are created. The invention aids the reel-building process by using a computer programmed with electronic spreadsheet software. An important advantage of the present invention is that the computer system reduces labor and time required for performing the complex computations needed to ensure proper sizing of the parent reel. In turn, this eliminates human computational error and reduces waste of time, materials, and labor.

Another advantage to the present invention is that it includes restricted data input, a graphical user interface, and help messages available on demand, all of which result in increased productivity and decreased user error. Other advantages of the present invention will become apparent from examination of the attached drawings and the following detailed description.

Figures 1, 2:
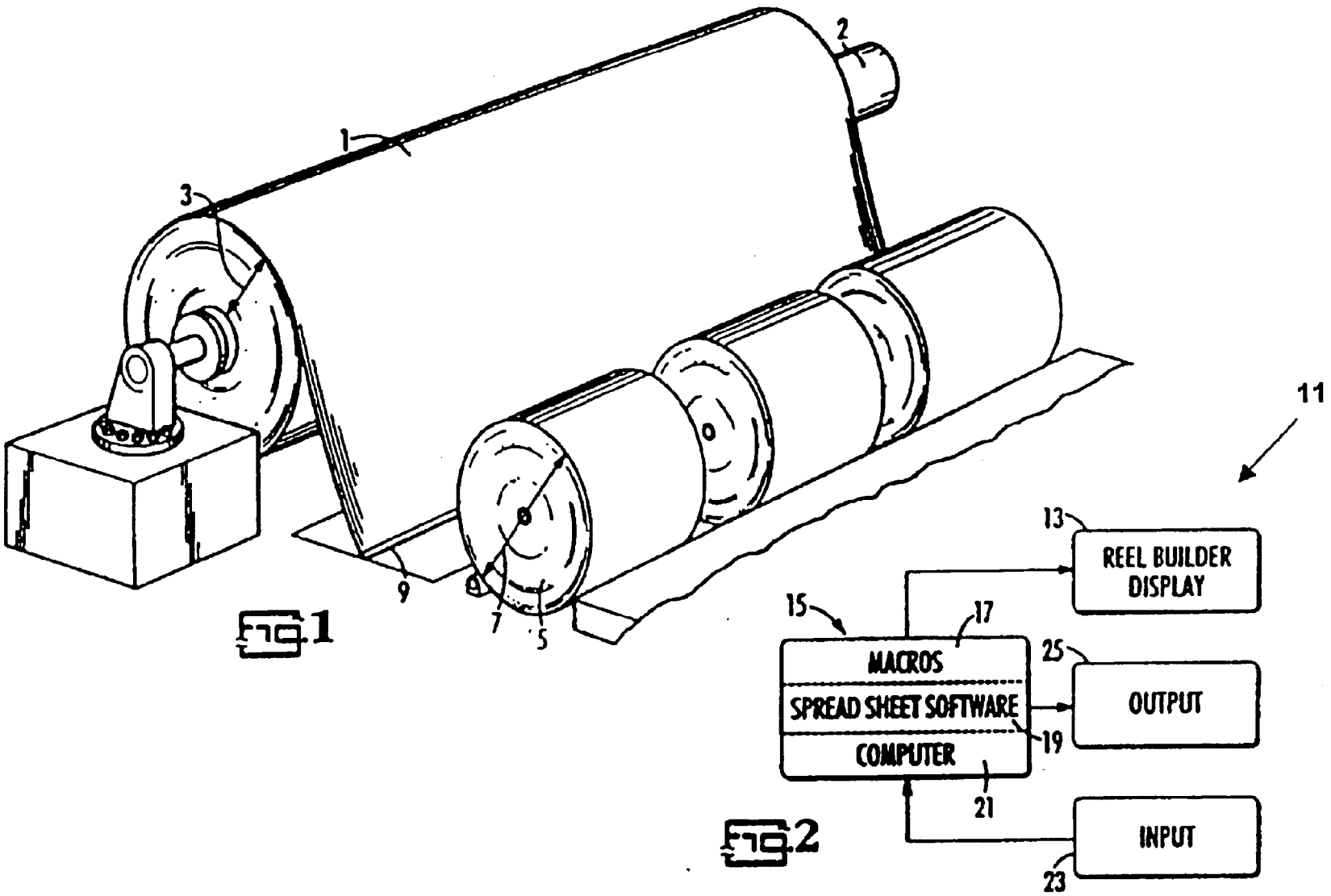
FIG. 1 illustrates aspects of the paper roll building process
FIG. 2 illustrates an example of the system in accordance with the invention.

FIG. 2 illustrates a paper reel construction system in accordance with the invention. The basic components of the system 11 are a computer system 15 comprised of a computer 21, spreadsheet software 19, and macros 17. The system 11 also provides a visual display 13. Output 25 may be sent to a printer or potentially another device, such as another computer. An input source 23 could be utilized to provide data to the computer system 15.

As explained in further detail, computer 21 is programmed to receive data, process the data, and display the results of the data being processed, with the data being related to sizing paper reels. The typical user of system 11 is a paper mill wherein paper reels are being constructed which will then be made into smaller rolls of paper for sale.

Recently-made paper is wound onto large spools. This is called a reel of paper, or a parent reel. The parent reel is measured in terms of diameter and area. The "reel diameter" is a term of art and does not correspond to the actual diameter of the parent reel and spool. The reel diameter, as used in regards to this invention, is the distance from the edge of the spool to the outer edge of the reel. However, this invention is easily modifiable to work with an actual measurement of a reel diameter, that is, the outer edge of a reel to the opposing outer edge.

The parent reel is then processed through a winding machine, where the paper is wound into smaller rolls of paper of varying widths and diameters. The rolls are combined into sets. A set can contain as many as fifteen rolls, depending on their width, although this may vary on different winders. The roll diameter or set diameter is the true diameter of the roll. Many sets of rolls of paper, each of a different diameter, may be made from one parent reel. These differing diameters for each set are known as set diameters.

It is imperative that the parent reel be just large enough to accommodate the intended sets to be made. If the reel does not contain enough paper, another reel must be loaded which contains enough paper to create the sets intended for it as well as enough paper to finish the sets left incomplete by the previous reel. The process of adding paper to a freshly-spooled reel when the previous reel was not long enough is called a top-out.

If the reel contains too much paper, then the remainder must be either topped-out in preparation for the next sets of rolls or slabbed off the reel. Paper which is slabbed is cut off the reel and recycled for later use in pulp form. This paper which remains on a reel after the requisite sets have been made is called slab loss. It is an object of this invention to minimize this slab loss.

Computer 21 may be any type of commercially available computer. Computer 21 is assumed to have conventional computer components such as memory, a processor, persistent storage and appropriate input/output interfaces.

In the example of this description, computer 21 is a "personal" computer capable of executing the Microsoft Windows™ operating system. Computer 21 stores and executes a type of software application known as a "spreadsheet" application 19. The preferred embodiment of the spreadsheet software 19 envisioned for this invention is Microsoft Excel™; however, the concepts described herein could be applied to computer 21 running other operating systems and comparable spreadsheet software. In addition to the spreadsheet software 19, macros 17 may be embedded into the spreadsheet 19. Macros are small programs embedded within and designed to work with a program, in this case the spreadsheet software, and which provide added functionality.

Figure 3:
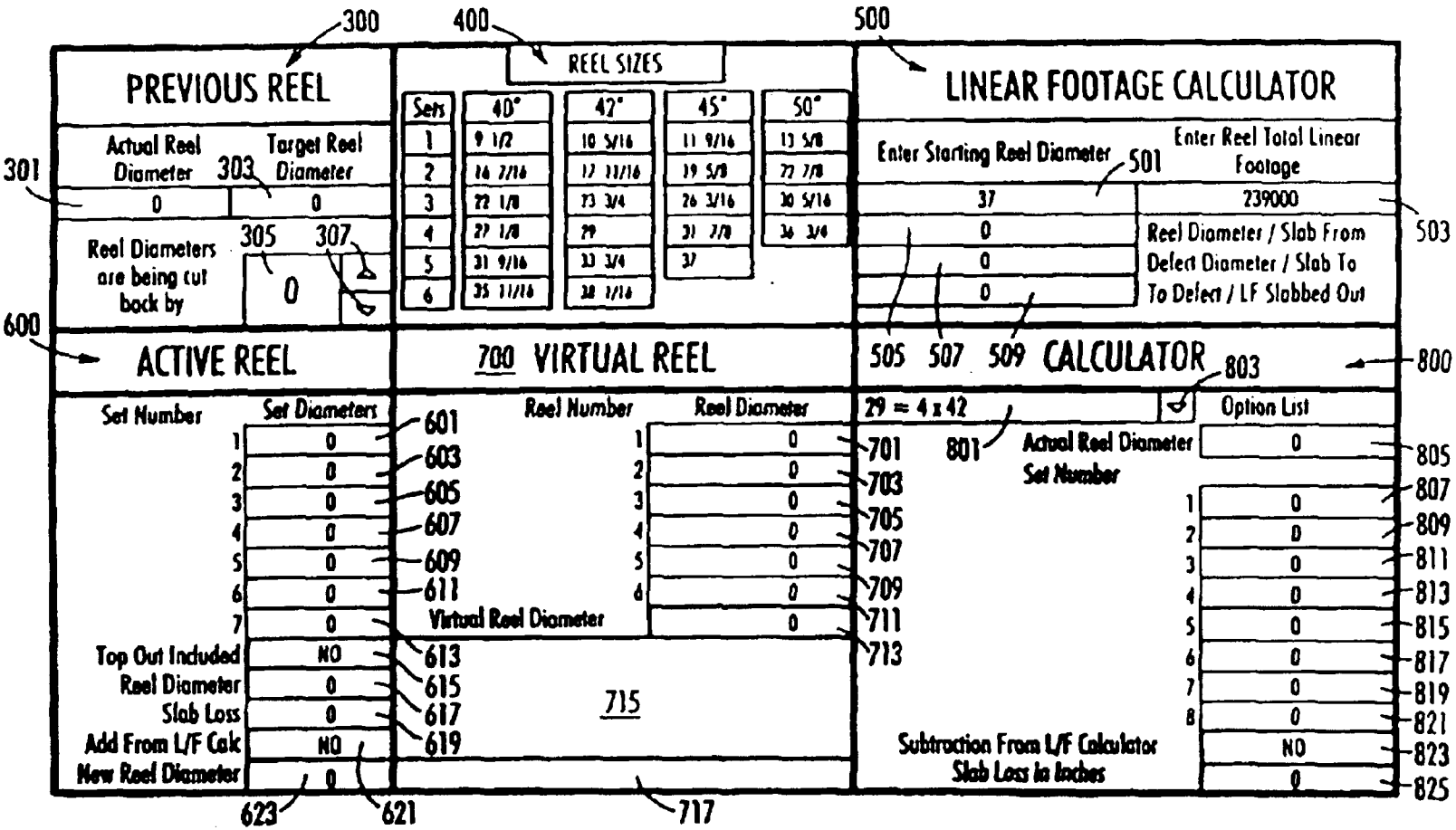
FIG. 3 represents the interface of the system in accordance with the invention.

FIG. 3 illustrates the interface of the system 11. It is through this interface, consisting of six discrete areas, that the invention is utilized. Each discrete area has a function, and when areas are used in combination with each other, other functions become apparent. The Previous Reel block 300 calculates the amount of paper needed for a top-out. The Reel Sizes Chart 400 displays the reel sizes for different set diameters. The Linear Footage Calculator block 500 calculates the linear footage in a reel, whether total, to a defect, or slabbed out of a reel. The Active Reel block 600 calculates the preferred diameter of the current reel being built. The Virtual Reel block 700 adds different reel diameters together. The Calculator block 800 calculates slab loss for a reel.

To calculate the desired reel diameter for certain set diameters, enter the diameter of each set to be built into the set diameter cells 601–613 of the Active Reel block 600. The preferred reel diameter which will build the desired sets without slab loss is the value in the Reel Diameter cell 617. If the reel needs to be cut back, adjust the amount in the Cut-Back Amount cell 305 using arrows 307. The new preferred reel diameter reflecting the cutback will appear in the Reel Diameter cell 617. The Previous Reel block 300 and Active Reel block 600 used in conjunction can also determine the preferred reel diameter when the amount of cutback is unknown.

To calculate a top-out for a reel, enter the actual reel diameter into the Actual Reel Diameter cell 301 and the target reel diameter into the Target Reel Diameter cell 303 in the Previous Reel block 300. Enter the set diameters into the set diameter cells 601–613 of the Active Reel block 600. The new preferred reel diameter reflecting the top-out will appear in the Reel Diameter cell 617 of the Active Reel block 600. An alert to this effect will appear in the message cell 715 of the Virtual Reel block 700.

To add reels together and calculate the equivalent reel size, enter the reel diameters into the reel diameter cells 701–711 of the Virtual Reel block 700. The combined reel diameter of those reels is equal to the resultant value in the Virtual Reel Diameter cell 713. Should a top-out be needed for the combined reel, the Virtual Reel Diameter 713 may be entered into the Actual Reel Diameter cell 805 of the Calculator block 800. The required set diameters are then entered into the Set Number cells 807–821 of the Calculator block 800. The slab loss for the reel diameter 805 is displayed in the Slab Loss in Inches cell 825. This may then be topped out using the Previous Reel block 300 as described earlier. If the reel diameter in the Virtual Reel Diameter cell 713 is less than the maximum reel diameter listed in the Reel Sizes chart it can be entered directly into the Actual Reel Diameter cell 301 of the Previous Reel Block 300, if a top-out is needed.

In addition to calculating slab loss, the Calculator block 800 may be used to determine what options are available for a reel, in terms of what combinations of set diameters can be made so as to result in zero slab loss. The option list 801 in the Calculator block 800 is a drop-down listing of many reel diameters and the corresponding set diameters which may be made with no slab loss. To access the list, the arrow 803 next to the option list 801 is clicked and the list is scrolled through as is common in computer operation.

The Linear Footage Calculator block 500 is used to calculate the total linear footage between two points in a reel. The values in the Starting Reel Diameter cell 501 and Reel Total Linear Footage cell 503 are used to calculate a multiplier for the conversion of area to linear footage. The values must be from a recently-built full size reel of the same grade paper as that being calculated. The reel diameter is entered into the Reel Diameter/Slab From cell 505 of the Linear Footage Calculator block 500. The diameter to which you wish to calculate the linear footage is entered into the Defect Diameter/Slab To cell 507. This value must be less than that entered into the Reel Diameter/Slab From cell 505. The linear footage of the distance between the Reel Diameter/Slab From cell 505 and the Defect Diameter/Slab To cell 507 is displayed in the To Defect/L/F Slabbed out cell 509. For example, if the user wished to calculate the total linear footage in a reel 38 inches in diameter, the user would enter "38" into the Reel Diameter/Slab From cell 505 and "0" into the Defect Diameter/Slab To cell 507. To determine the total linear footage to a single defect in a reel, replace the "0" in the above example with the diameter of the reel defect.

Cull paper is paper on a reel which does not meet the necessary specifications and cannot be wound onto a roll for sale. Often, sets must be added on top of cull paper already existing on a reel. The calculations to accomplish this with a minimum of waste is accomplished via the present invention. The linear footage between where the cull paper ends and the good paper begins is calculated as described above. Enter the desired set diameters into the Set Diameters cells 601–613 in the Active Reel block 600. The resultant value in the New Reel Diameter cell 623 includes the Reel Diameter value 617 and an adjustment for the Linear Footage Calculator entry. A message to this effect is displayed in the message cell 715 of the Virtual Reel block 700.

To build a top-out for a reel from which cull paper must be slabbed, the Linear Footage Calculator block 500 is used to determine the linear footage between where the cull paper begins and ends in the reel. The actual reel diameter and a target reel diameter is then input into the Actual Reel Diameter cell 301 and Target Reel Diameter cell 303 in the Previous Reel block. The desired set diameters are input into the Set Diameters cells 601–613 in the Active Reel block 600. The resultant value in the New Reel Diameter cell 623 includes the Reel Diameter value 617 and an adjustment for the amount of paper slabbed out of the reel.

An unmarked roll defect may be located using the present invention. The Linear Footage Calculator 500 is used to determine the reel diameter at the defect. The Calculator block 800 is then utilized to pinpoint the set and location of the roll defect.

Figure 4:
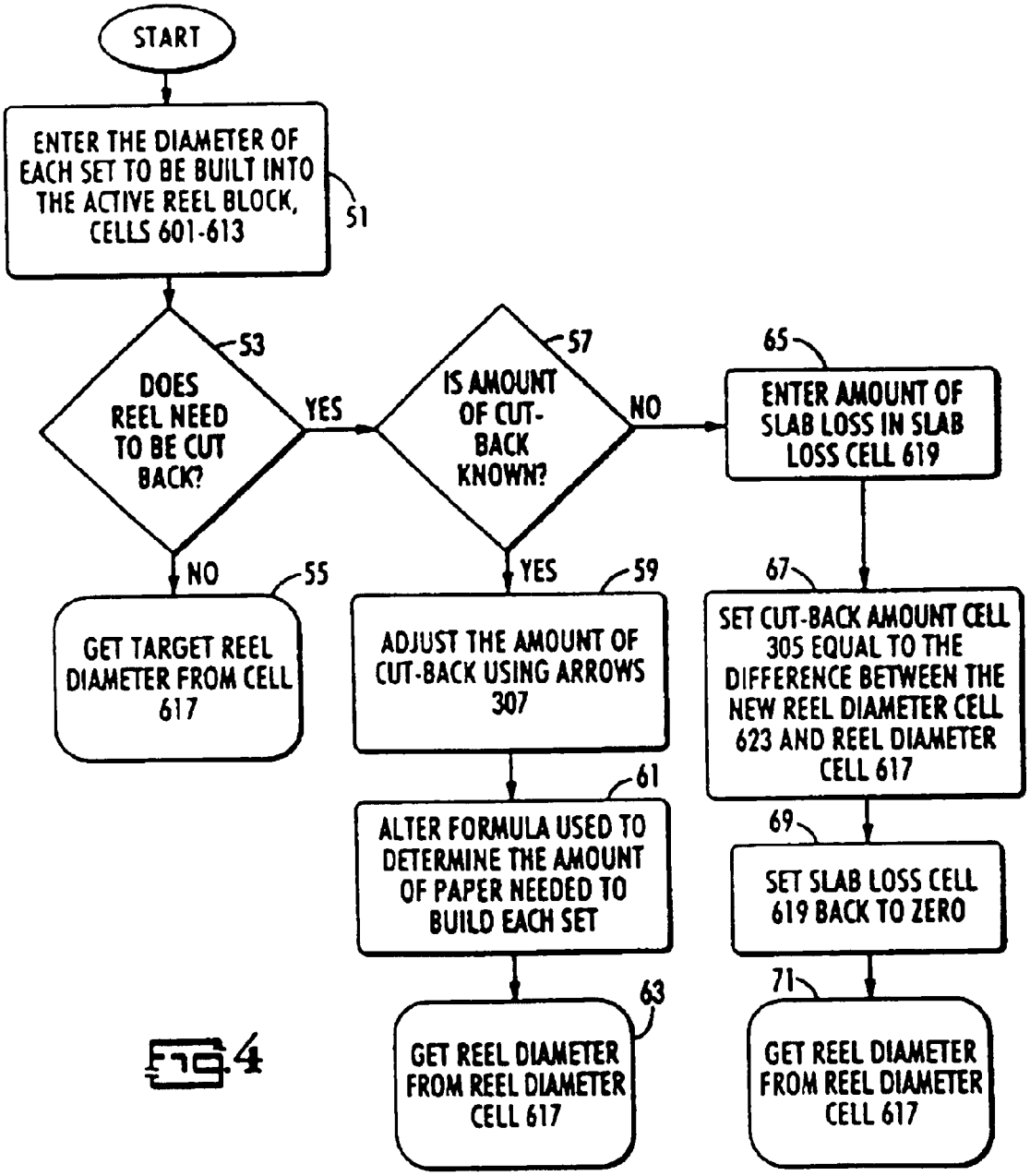
FIG. 4 is a flow chart illustrating calculating reel diameter with a cut-back.

FIG. 4 illustrates the desired steps to calculate a preferred reel diameter with or without a cut-back. First 51 the diameter of each set should be entered into the Set Diameters cells 601–613 of the Active Reel Block 600. Next 53 a determination should be made as to whether the reel needs to be cut back. If not 55, then the Reel Diameter cell 617 in the Active Reel Block 600 contains the preferred reel diameter. If the reel needs to be cut back, a determination should be made as to whether the amount of cut-back is known 57. If yes, then the Cut-Back Amount cell 305 should be adjusted 59 to the needed cut-back amount using arrows 307. This alters the formulas used to determine the amount of paper needed to build each set 61, and the preferred reel diameter may be located 63 in the Reel Diameter cell 617. If the amount of cut-back is unknown, first 65 enter the amount of slab loss into the Slab Loss cell 619. Then 67 set the Cut-Back Amount cell 305 equal to the difference between the New Reel Diameter cell 623 and the Reel Diameter cell 617. Set the Slab Loss cell 619 back to zero 69. Obtain 71 the preferred reel diameter from the Reel Diameter cell 617.

Figure 5:
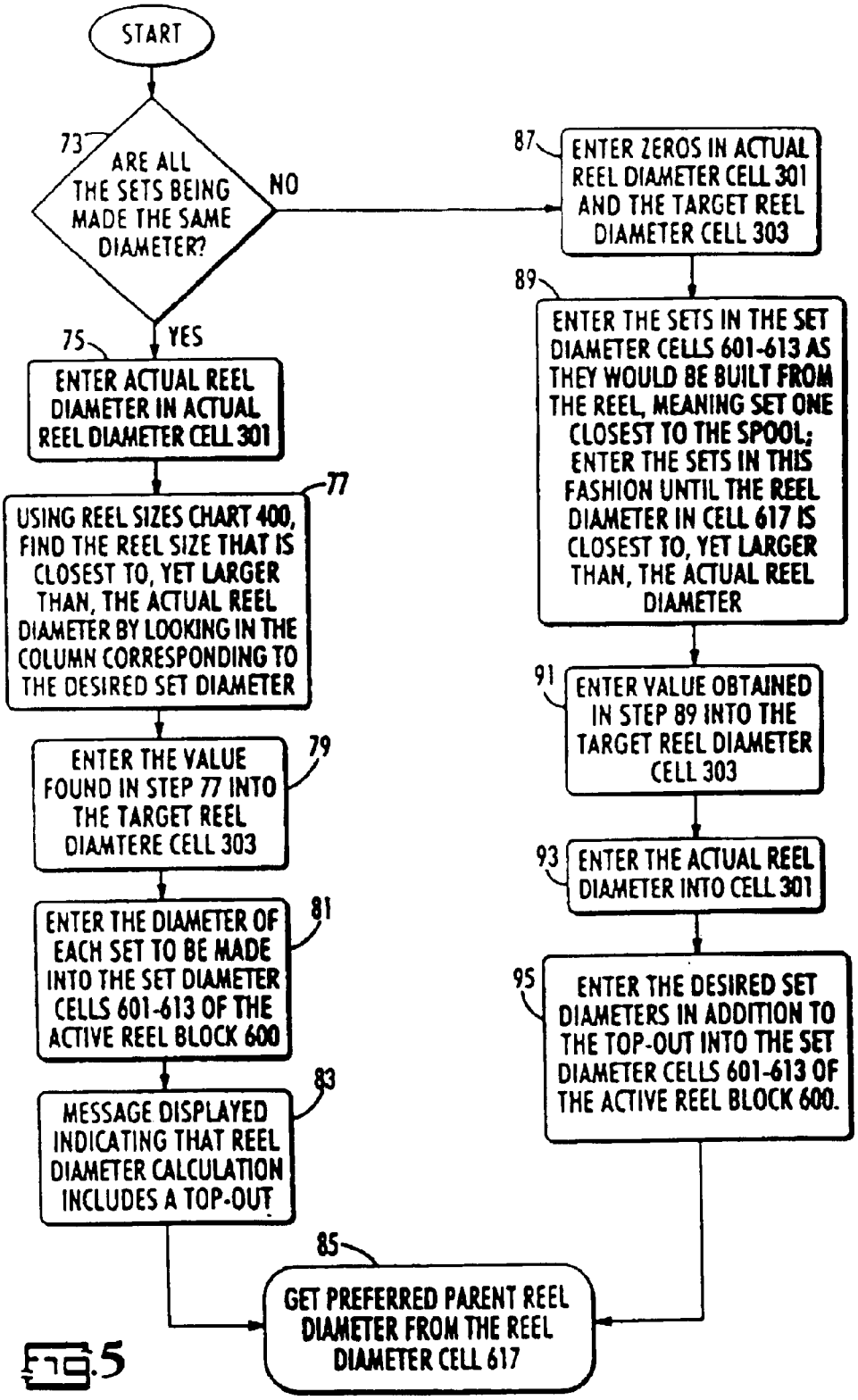
FIG. 5 is a flow chart illustrating calculating a top-out.

FIG. 5 illustrates the desired steps to calculate a top-out for a reel. First, determine if all the sets being made are the same diameter 73. If yes, then the first step 75 is to enter the actual reel diameter into the Actual Reel Diameter cell 301 in the Previous Reel block 300. Next 77, using the Reel Sizes chart 400, find the reel size that is closest to, yet larger than the actual reel diameter 301 by looking in the column corresponding to the desired set diameter. Next 79, enter the value found in step 77 into the Target Reel Diameter cell 303. Next 81, enter the diameter of each set to be made into the Set Diameter cells 601–613 of the Active Reel Block 600. This causes a message to be displayed 83 in the Top Out Included cell 615 that the reel diameter calculation includes a top-out. Finally, the desired parent reel diameter may be obtained 85 from the Reel Diameter cell 617.

If all the sets being made ate not of the same diameter, then the first step 87 is to enter zeros in the Actual Reel Diameter cell 301 and the Target Reel Diameter cell 303 of the Previous Reel Block 300. Next 89, enter the sets into the Set Diameters cells 601–613 of the Active Reel block 600 as they would be built from the reel, meaning set one 601 is the set closest to the spool. Enter the sets in this fashion until the Reel Diameter in cell 617 is closest to, yet larger than, the actual reel diameter. Next 91, enter the value in the Reel Diameter cell 617, obtained in step 89, into the Target Reel Diameter cell 303. Next 93, enter the actual reel diameter into the Actual Reel Diameter cell 301. Next 95, enter the set diameters desired on the reel in addition to the top-out into the Set Diameters cells 601–613 of the Active Reel block 600, and the preferred parent reel diameter may be obtained 85 from the Reel Diameter cell 617.

Figure 6:
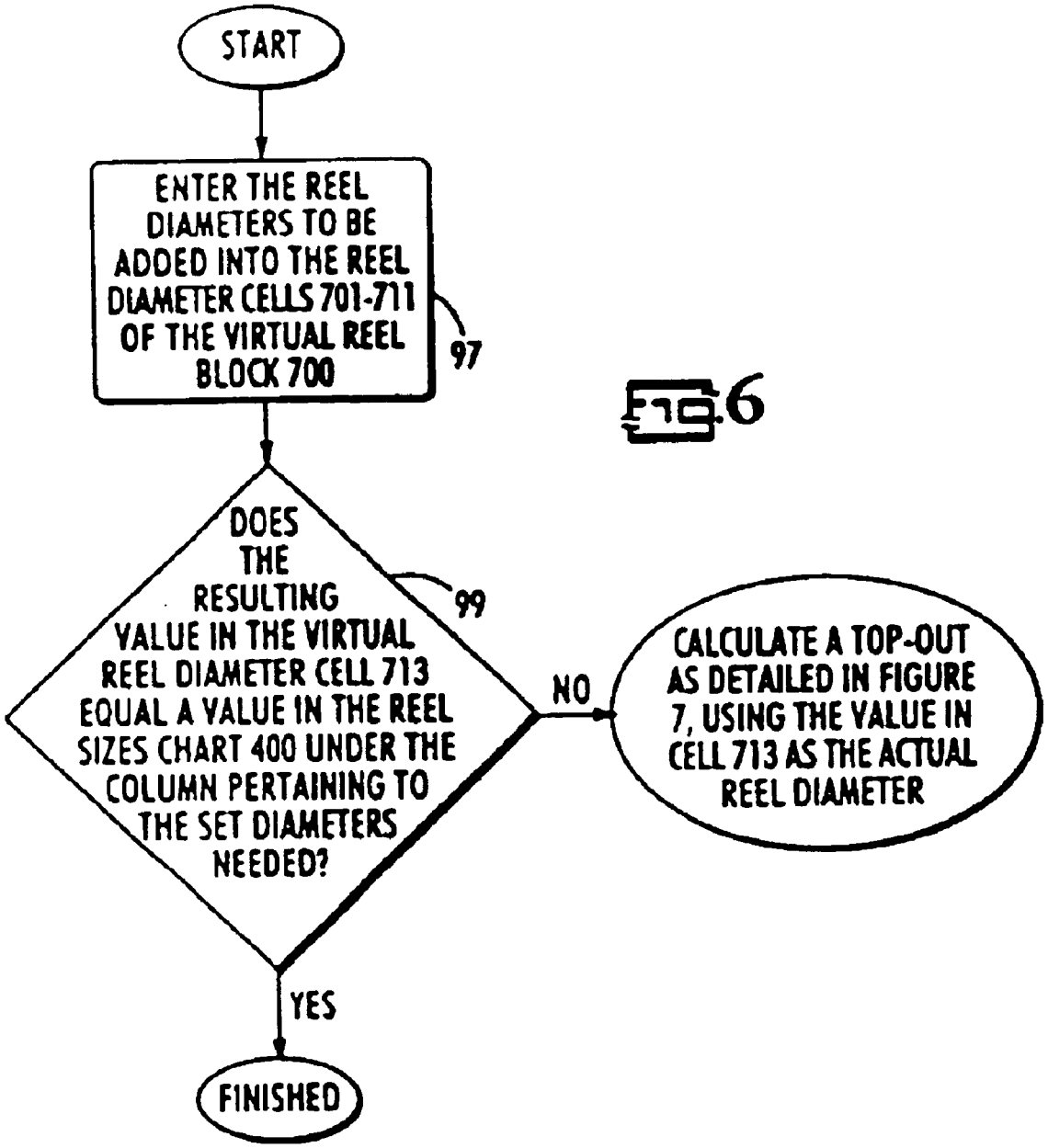
FIG. 6 is a flow chart illustrating adding reels together.

FIG. 6 illustrates the desired steps to add reels together. First 97, enter the reels to be added into the Reel Diameter cells 701–711 of the Virtual Reel block 700. Next 99, if the resulting value in the Virtual Reel Diameter cell 713 equals a value in the Reel Sizes chart 400 under the column pertaining to the desired set diameters, then the value in the Virtual Reel Diameter cell 713 is the desired size of the reel.

If step 99 reflects that the resulting value in cell 713 is not equal to a value in the Reel Sizes chart 400 under the column pertaining to the desired set diameters, then a top-out must be calculated as detailed in FIG. 5, using the value in cell 713 as the actual reel diameter.

Figure 7:
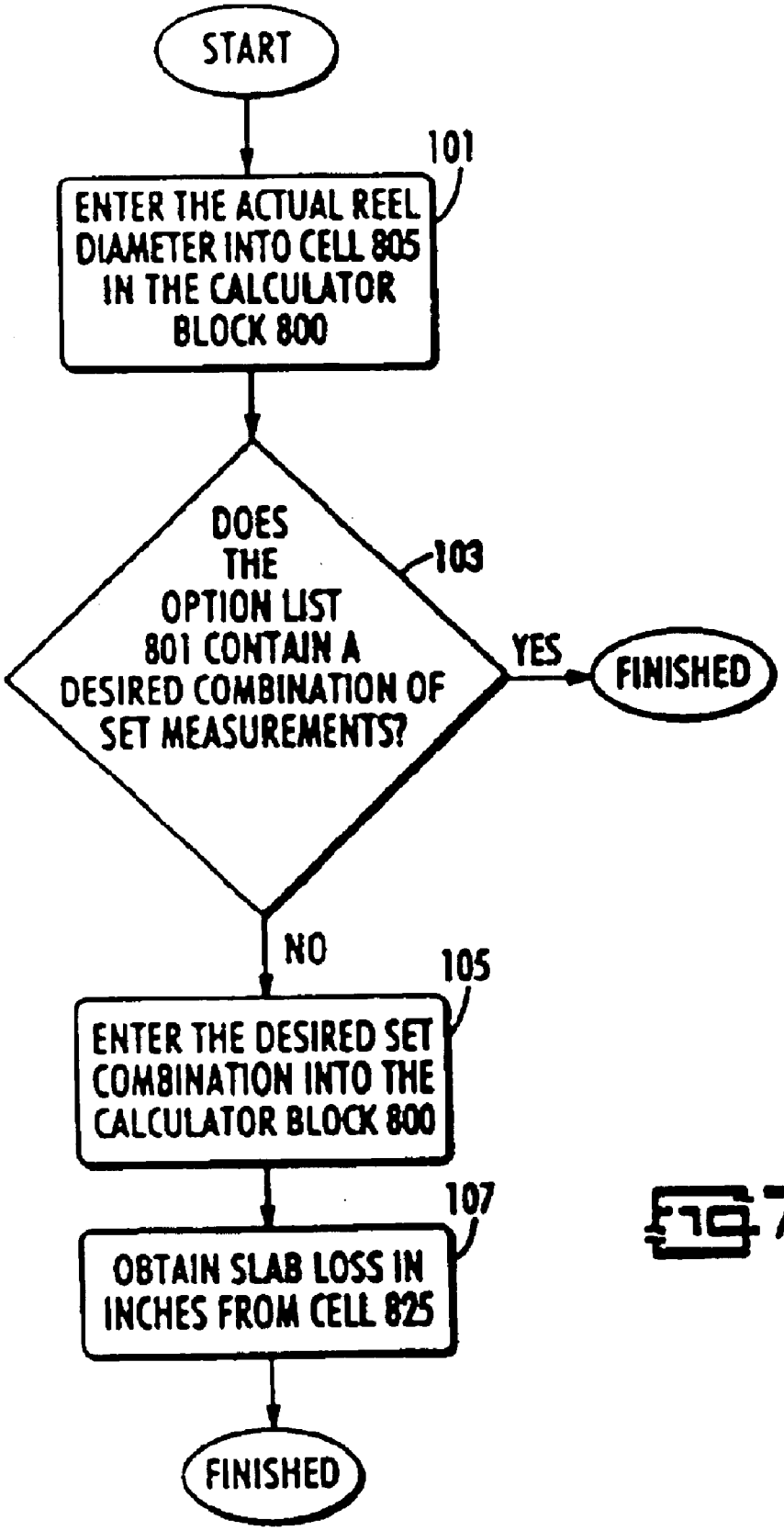
FIG. 7 is a flow chart illustrating determining slab loss for a reel.

FIG. 7 illustrates the desired steps to determine slab loss for a reel. First 101, enter the actual reel diameter into the Actual Reel Diameter cell 805 in the Calculator Block 800. Then 103 if the option list 801 contains the desired combination of set measurements which equal the actual reel diameter, there is no slab loss. The option list 801 may be accessed by clicking on the arrow 803. If the option list 801 does not contain a suitable combination, then 105 enter the desired set combination into the Set Number cells 807–821 in the Calculator block 800. The slab loss in inches may then be obtained 107 from the Slab Loss in Inches cell 825 in the Calculator block 800.

Figure 8:
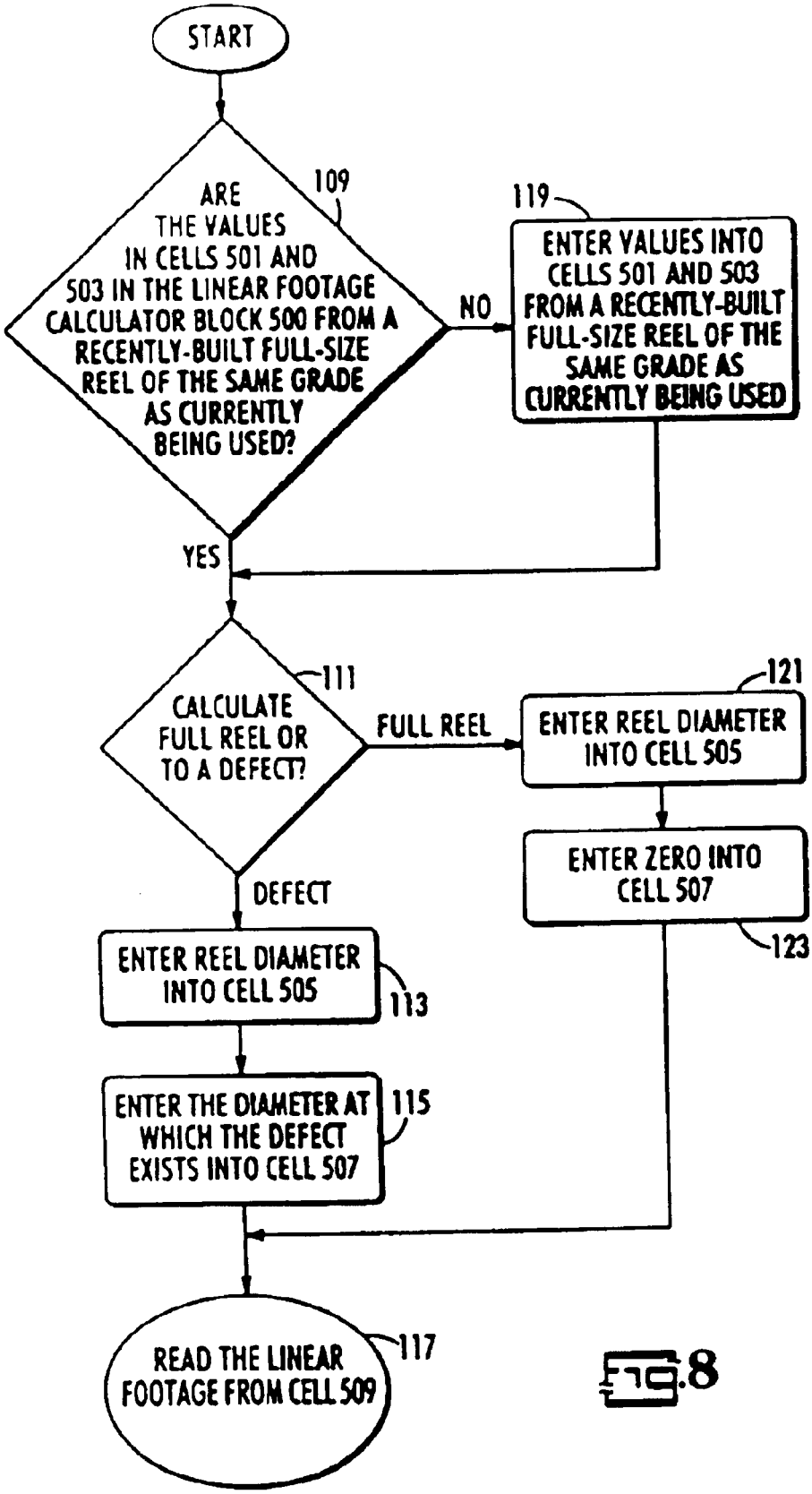
FIG. 8 is a flow chart illustrating calculating total linear footage in a reel and linear footage to a single defect.

FIG. 8 illustrates the desired steps to calculate total linear footage in a reel or the linear footage to a single defect in a reel. First 109, the values in the Starting Reel Diameter cell 501 and the Enter Reel Total Linear Footage cell 503 in the Linear Footage Calculator block 500 must be current; that is, from a recently-built full-size reel of the same grade as currently being used. These values are used as constants in several of the preexisting embedded formulas in the invention. If the numbers are not current 119, then enter current values into the cells. Then 111, if the total linear footage of the reel is desired, 121 enter the reel diameter into the Reel Diameter/Slab From cell 505. Next 123 enter zero into the Defect Diameter/Slab To cell 507. The total linear footage for the reel may be obtained 117 from the To Defect/L/F Slabbed Out cell 509.

If the linear footage to a single defect is desired, 113 enter the reel diameter into the Reel Diameter/Slab From cell 505. Next 115, enter the diameter at which the defect is located into the Defect Diameter/Slab To cell 507. The value in the Reel Diameter must always be equal to or larger than the value in the Defect Diameter cell 507. The linear footage to the defect may be obtained 117 from the To Defect/L/F Slabbed Out cell 509 of the Linear Footage Calculator block 500.

Figure 9:
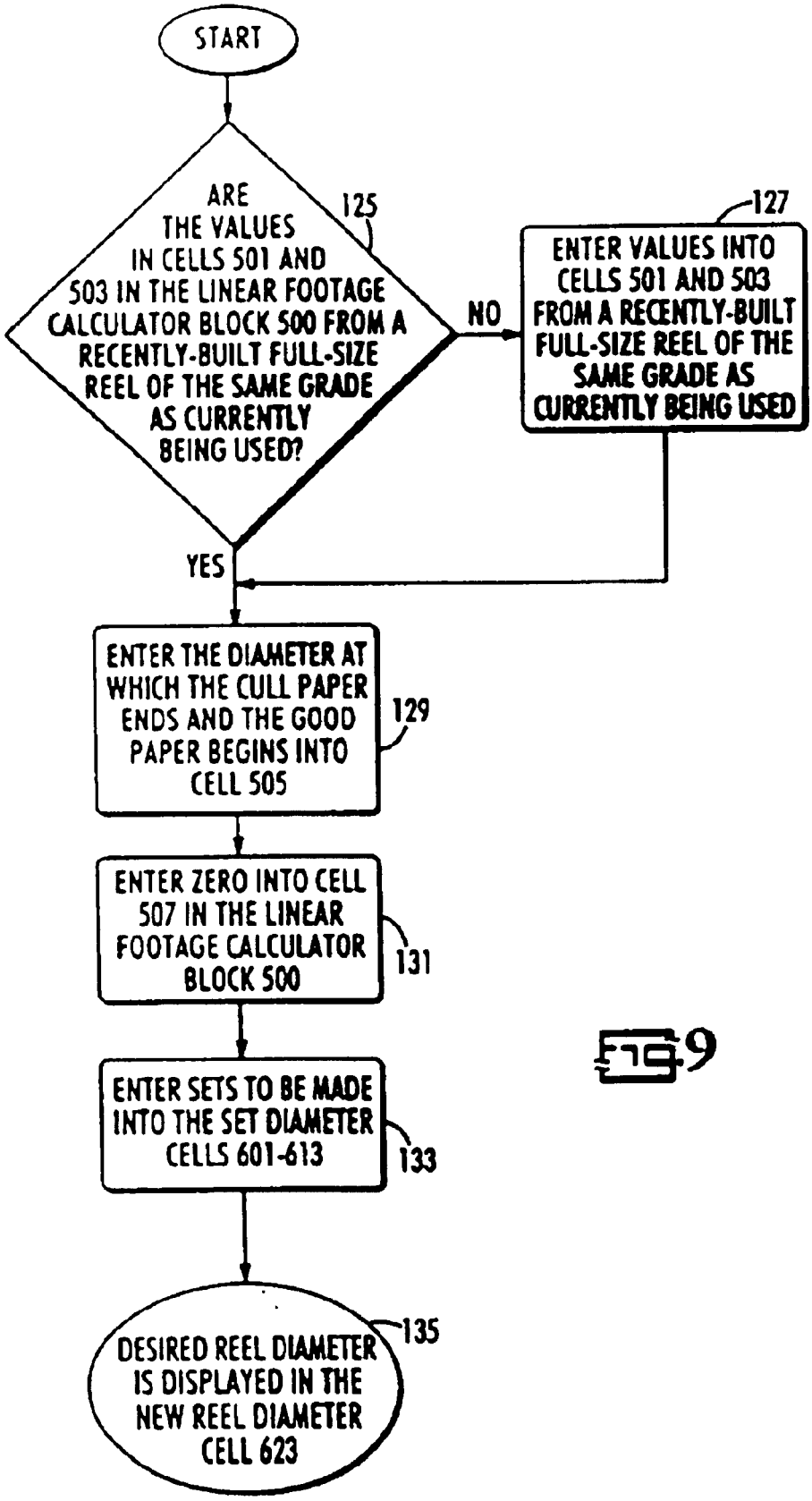
FIG. 9 is a flow chart illustrating adding sets on top of cull paper.

FIG. 9 illustrates the desired steps to add sets of paper on top of cull paper. First 125, the values in the Starting Reel Diameter cell 501 and the Enter Reel Total Linear Footage cell 503 in the Linear Footage Calculator block 500 must be current; that is, from a recently-built full-size reel of the same grade as currently being used. These values are used as constants in several of the preexisting embedded formulas in the invention. If the numbers are not current 127, then enter current values into the cells. Then 129, enter the diameter at which the cull paper ends and the good paper begins into the Reel Diameter/Slab From cell 505. Next 131, enter zero into the Defect Diameter/Slab To cell 507. Next 133, enter the sets to be put on top of the cull paper into the Set Diameters cells 601–613 in the Active Reel Block 600. The desired reel diameter is displayed in the New Reel Diameter cell 623 of the Active Reel Block 600. If the Linear Footage Calculator block is being used, a "YES" will be displayed in the Add From L/F Calc cell 621 of the Active Reel Block 600. Additionally, the message window 715 will contain a message that the New Reel Diameter calculation 623 includes an adjustment for the Linear Footage Calculator entry. If using the Linear Footage Calculator Block 500 in conjunction with the Calculator block 800, a message will appear to that effect in the secondary message window 717.

Figure 10:
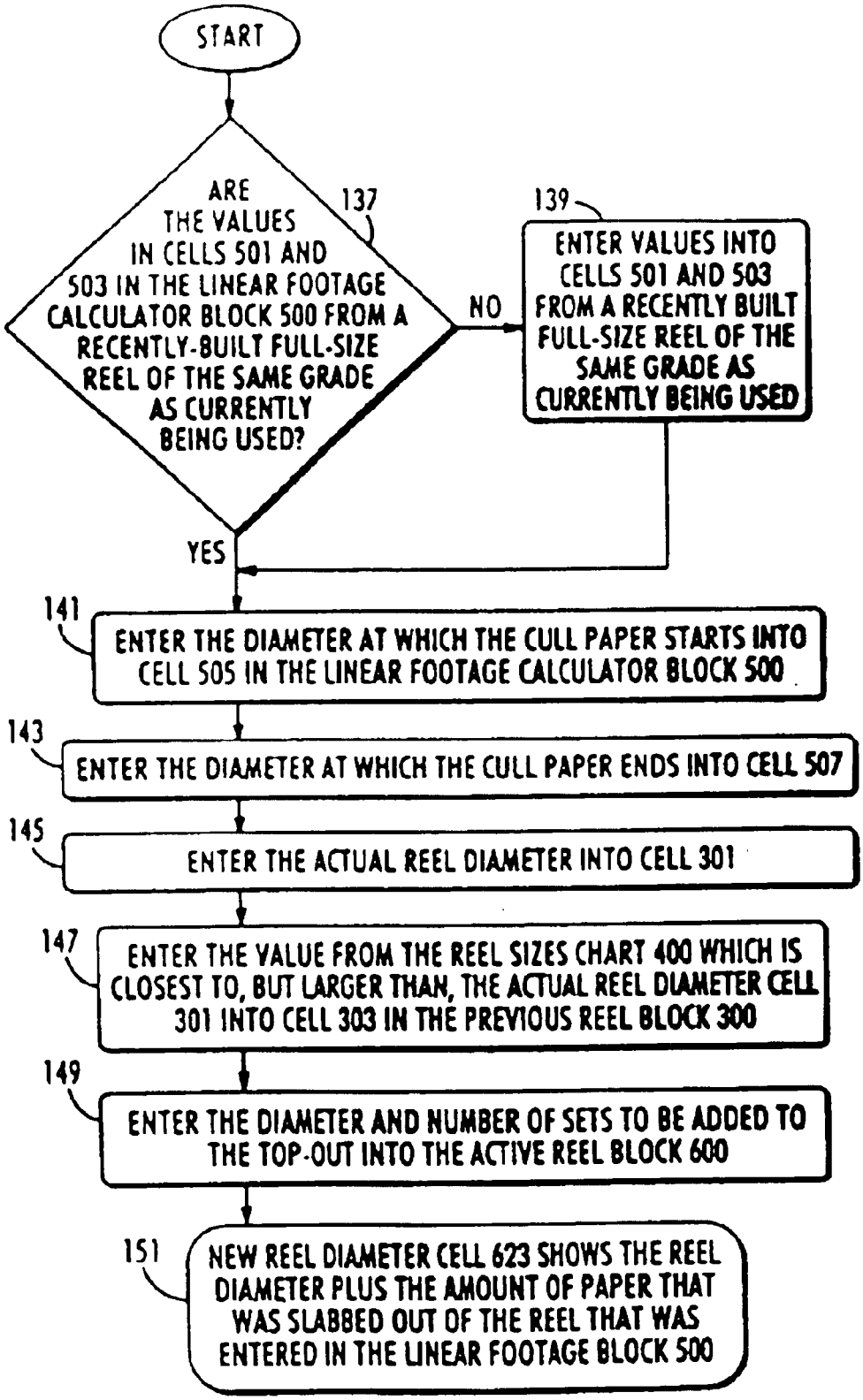
FIG. 10 is a flow chart illustrating slabbing out a defect with a top-out.

FIG. 10 illustrates the desired steps to calculate a top-out for a reel that also contains cull paper that must be slabbed out of the reel. First 137, the values in the Starting Reel Diameter cell 501 and the Enter Reel Total Linear Footage cell 503 in the Linear Footage Calculator block 500 must be current; that is, from a recently-built full-size reel of the same grade as currently being used. These values are used as constants in several of the preexisting embedded formulas in the invention. If the numbers are not current 139, then enter current values into the cells. Then 141, enter the diameter at which the cull paper starts into the Reel Diameter/Slab From cell 505 in the Linear Footage Calculator 500. Next 143, enter the diameter where the cull paper ends into the Defect Diameter/Slab To cell 507. Next 145, enter the actual reel diameter into the Actual Reel Diameter cell 301 in the Previous Reel Block 300. Next 147, enter a value from the Reel Sizes Chart 400 which is closest to, but larger than, the value in the Actual Reel Diameter cell 301 from step 145 into the Target Reel Diameter cell 303 in the Previous Reel Block 300. Next 149, enter the desired diameter and number of sets to be added to the top-out into the Set Diameters cells 601–613 in the Active Reel Block 600. The New Reel Diameter cell 623 shows 151 the Reel Diameter 617 plus the amount of paper that was slabbed out of the reel that was entered into the Linear Footage Block 500. The Top Out Included cell 615 and Add From L/F Calc cell 621 will both reflect a "YES" value, and the message block 715 and 717 will display messages alerting the user to the adjustments being made.

Figure 11:
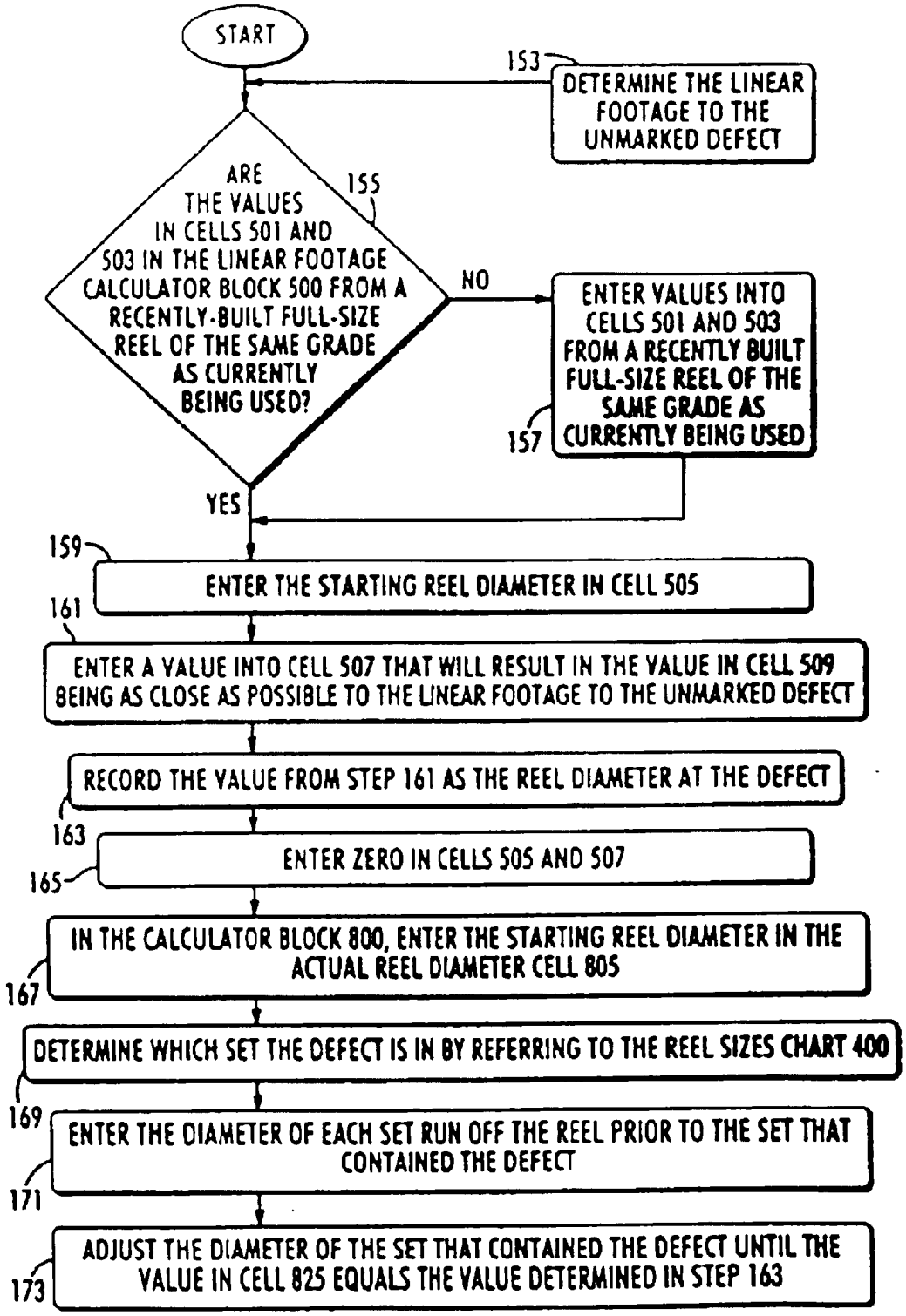
FIG. 11 is a flow chart illustrating finding an unmarked roll defect.

FIG. 11 illustrates the desired steps to find an unmarked roll defect. The ability to calculate the linear footage to unmarked defects in parent reels can prevent winder breaks and the selling of a defective roll. Winder breaks result in lost production. First 153, determine the linear footage to the unmarked roll defect. Next 155, the values in the Starting Reel Diameter cell 501 and the Enter Reel Total Linear Footage cell 503 in the Linear Footage Calculator block 500 must be current; that is, from a recently-built full-size reel of the same grade as currently being used. These values are used as constants in several of the preexisting embedded formulas in the invention. If the numbers are not current 157, then enter current values into the cells. Next 159, enter the starting reel diameter into the Reel Diameter/Slab From cell 505. Next 161, enter a value into the Defect Diameter/Slab To cell 507 that will result in the value in the To Defect/L/F Slabbed Out cell 509 being as close as possible to the linear footage to the unmarked roll defect, as determined in step 153. Continue entering different values into the Defect Diameter/Slab To cell 507 until this is accomplished. Record the value 163 as the reel diameter at the defect. Next 165, enter values of zero into the Reel Diameter/Slab From cell 505 and the Defect Diameter/Slab To cell 507. Next 167, enter the starting reel diameter into the Actual Reel Diameter cell 805 of the Calculator Block 800. Next 169, by referring to the Reel Sizes chart 400, it can be determined which set contains the defect. Next 171, in the Set Number cells 807–821, enter the diameter of each set ran off the reel prior to the set that contains the defect. Next 173, adjust the diameter of the set that contained the defect until the value in the Slab Loss in Inches cell 825 equals the value for the reel diameter at the defect as determined in step 163.

Although the present invention has been described in detail, it should be understood that the system 101 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A method for building paper reels efficiently and with a minimum of waste, said reels to be rewound into a plurality of rolls, said method employing a computer system and comprising the steps of:

Collecting data related to the construction of said reels and rolls, said data comprising measurements of preexisting paper reels, desired measurements and quantity of rolls to be built, amount of slab loss for said reel or reels, amount to be cut back from said reel or reels and measurements relating to the location of a defect in said reel or reels;

Inputting said data into said computer system, said computer system comprising a data entry means, data processing means, memory means and a display means;

Storing said data using said computer system;

Comparing said data to preexisting data and predetermined parameters and guidelines;

Using said data in calculations, said calculations using predetermined formulas, wherein said formulas are chosen depending upon the value of said data, said calculations resulting in one or a plurality of products;

Replacing one or a plurality of values with said products;

Displaying said data, said products and said values in a format readable for use in building said reel or reels.

2. The method of claim 1, wherein a software application is executed by said computer system.

3. The method of claim 2, wherein said software application is a spreadsheet software application.

4. The method of claim 3, further comprising user modifications to said spreadsheet software application.

5. The method of claim 4, wherein said user modifications include one or a plurality of macros.

6. The method of claim 1, further comprising the use of a Graphical User Interface (GUI) to facilitate said inputting of data.

7. The method of claim 6, wherein said GUI comprises menus, dialog boxes, computer-generated messages, restricted data entry, hidden formulas, hidden comments made visible on demand and interactive help messages.

8. The method of claim 1, further comprising the step of calculating a preferred diameter for said reel being built so as to minimize waste when said rolls are built from said reel.

9. The method of claim 8, further comprising the step of calculating the preferred diameter for said reel where said rolls being built from said reel are to be cut back by a predetermined amount.

10. The method of claim 8, further comprising the step of calculating the preferred diameter for said reel where said rolls being built from said reel are to be cut back by an unknown amount.

11. The method of claim 1, further comprising the step of calculating a preferred diameter for said reel being built where a top-out is necessary for said reel and where all sets of paper rolls to be built from said reel are to be the same diameter.

12. The method of claim 1, further comprising the step of calculating a top-out for said reel where one or a plurality of different set diameters are to be built from said reel.

13. The method of claim 1, further comprising the step of adding reels together and calculating an equivalent reel size.

14. The method of claim 13, further comprising the step of adding reels together and subsequently calculating a top-out so as to minimize waste when building said rolls from said added-together reel.

15. The method of claim 1, further comprising the step of calculating slab loss where a plurality of rolls are to be built from said reel.

16. The method of claim 1, further comprising a list of predetermined options for building a plurality of rolls from said reel with a minimum of waste, where said reel and rolls consist of varying diameters.

17. The method of claim 16, wherein said list is presented in the form of a drop-down scrollable list.

18. The method of claim 1, further comprising the step of calculating the total linear footage of paper in said reel.

19. The method of claim 18, further comprising the step of calculating the total linear footage between two predetermined points on said reel.

20. The method of claim 1, further comprising the step of calculating a preferred diameter for said reel being built where cull paper exists on said reel.

21. The method of claim 20, further comprising the step of calculating a preferred diameter for said reel being built where said reel contains cull paper and a top-out is necessary.

22. A method for building paper reels efficiently and with a minimum of waste, said reels to be rewound into a plurality of rolls, said method employing a computer system and comprising the steps of:

Collecting data related to the construction of said reels and rolls, said data comprising measurements of preexisting paper reels, desired measurements and quantity of rolls to be built, amount of slab loss for said reel or reels, amount to be cut back from said reel or reels and measurements relating to the location of a defect in said reel or reels;

Inputting said data into said computer system, said computer system composing a data entry means, data processing means, memory means and a display means;

Storing said data using said computer system;

Comparing said data to preexisting data and predetermined parameters and guidelines;

Using said data in calculations, said calculations using predetermined formulas, wherein said formulas are chosen depending upon the value of said data, said calculations resulting in one or a plurality of products;

Replacing one or a plurality of values with said products;

Displaying said data, said products and said values in a format readable for use in building said reel or reels, and calculating the diameter at which an unmarked defect exists in one of a plurality of said rolls.

* * * * *